US008631784B2

(12) United States Patent
Brand et al.

(10) Patent No.: US 8,631,784 B2
(45) Date of Patent: Jan. 21, 2014

(54) FLANGE DEVICE AND INTAKE SYSTEM

(75) Inventors: Winfried Brand, Stuttgart (DE); Ivano Morgillo, Neuhütten (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/511,328

(22) PCT Filed: Nov. 18, 2010

(86) PCT No.: PCT/EP2010/067737

§ 371 (c)(1),
(2), (4) Date: Aug. 13, 2012

(87) PCT Pub. No.: WO2011/061250

PCT Pub. Date: May 26, 2011

(65) Prior Publication Data

US 2012/0298064 A1 Nov. 29, 2012

(30) Foreign Application Priority Data

Nov. 23, 2009 (DE) ..... 10 2009 053 986

(51) Int. Cl.
*F02M 55/02* (2006.01)

(52) U.S. Cl.
USPC ..... 123/469; 123/184.61; 123/184.21; 123/456

(58) Field of Classification Search
USPC ..... 123/336, 456, 468, 469, 470, 471, 123/184.21, 184.24, 184.34, 184.42, 123/184.47, 184.61, 198 E
See application file for complete search history.

(56) References Cited

U.S. PATENT DOCUMENTS 5,002,030 A * 3/1991 Mahnke ..... 123/469

(Continued)

FOREIGN PATENT DOCUMENTS

DE 19742908 A1 4/1998
DE 10251406 A1 6/2004

(Continued)

OTHER PUBLICATIONS

English abstract for DE-10251406.

(Continued)

*Primary Examiner* — Hung Q Nguyen
(74) *Attorney, Agent, or Firm* — Rader, Fishman & Grauer PLLC

(57) ABSTRACT

A flange device for an air induction device of an internal combustion engine may include a housing of plastic having at least one inlet channel for each cylinder of the internal combustion engine. A fuel distribution rail of metal may have a connection for each cylinder for connecting a fuel injector, wherein the housing may have a flange that surrounds the outlet openings of the inlet channels and be configured to fasten the housing on the internal combustion engine. The housing may have a plurality of bridge sections that overlap the fuel distribution rail on a side facing away from the flange. Each bridge section may have a support sleeve arranged distally to the inlet channels and be configured to fasten the respective bridge section on the internal combustion engine.

20 Claims, 5 Drawing Sheets

(56) References Cited

U.S. PATENT DOCUMENTS

| | | | | |
|---|---|---|---|---|
| 5,003,933 | A * | 4/1991 | Rush et al. | 123/184.42 |
| 5,172,671 | A * | 12/1992 | Peters et al. | 123/470 |
| 5,357,931 | A * | 10/1994 | Semence | 123/456 |
| 5,713,323 | A | 2/1998 | Walsh et al. | |
| 6,601,564 | B2 * | 8/2003 | Davey | 123/456 |
| 6,817,337 | B1 * | 11/2004 | Siring et al. | 123/198 E |
| 7,591,246 | B2 * | 9/2009 | Beardmore et al. | 123/456 |
| 7,802,558 | B2 * | 9/2010 | Panchal | 123/456 |
| 2001/0035161 | A1 * | 11/2001 | Kehoe | 123/456 |
| 2002/0029762 | A1 * | 3/2002 | Scollard et al. | 123/456 |
| 2003/0015170 | A1 | 1/2003 | Klotz et al. | |
| 2005/0045155 | A1 | 3/2005 | Harvey et al. | |

FOREIGN PATENT DOCUMENTS

| | | | |
|---|---|---|---|
| EP | 1270917 | A2 | 1/2003 |
| EP | 1533514 | A2 | 5/2005 |
| EP | 1568880 | A2 | 8/2005 |
| EP | 2148076 | A1 | 1/2010 |
| WO | WO-01/48368 | A1 | 7/2001 |

OTHER PUBLICATIONS

English abstract for EP-1533514.

* cited by examiner

FLANGE DEVICE AND INTAKE SYSTEM

CROSS-REFERENCE TO RELATED APPLICATIONS

This application claims priority to German Patent Application 10 2009 053 986.7 filed on Nov. 23, 2009 and PCT/EP2010/067737 filed on Nov. 18, 2010, which are hereby incorporated by reference in their entireties.

TECHNICAL FIELD

The present invention relates to a flange device for an air induction device of an internal combustion engine, in particular of a motor vehicle. The invention also relates to an intake system equipped with such a flange device.

BACKGROUND

From WO 2001/048368 A1 a flange device for an intake system of an internal combustion engine is known, which has a plastic housing and a metal fuel distribution rail. The housing has an inlet channel for each cylinder of the internal combustion engine, and the fuel distribution rail has a connection for each cylinder for connecting a fuel injector. Furthermore, the known flange device is equipped with a metal hold-down device, by means of which the housing can be fastened to the internal combustion engine, wherein this hold-down device overlaps the fuel distribution rail, so that with the fastening of the housing, the fuel distribution rail is also fixed at the same time.

From EP 1 270 917 A2 a further flange device is known, which again has a plastic housing and a metal fuel distribution rail. In the known flange device, bridge sections are formed integrally on the fuel distribution rail, which overlap the housing adjacent to the inlet channels and by which the fuel distribution rail and hence also the housing are fastened to the internal combustion engine.

From DE 197 42 908 A1 an intake system is known, the housing of which is made from plastic and on which a metal fuel distribution rail is fastened.

From DE 102 51 406 A1 a further flange device is known, in which a plastic housing is fastened on the internal combustion engine, wherein the housing overlaps with detent recesses in a form-fitting manner collar-shaped pipe ends of branch pipes of a coolant distributor pipe, in order to thereby at the same time fasten the coolant distributor pipe on the internal combustion engine. In so doing, the coolant distributor pipe runs between the branch pipes on a side of the housing facing away from the internal combustion engine, whereby it overlaps the sections of the housing cooperating with the pipe ends.

SUMMARY

The present invention is concerned with the problem of indicating for a flange device or respectively for an intake system of the type mentioned in the introduction an improved or at least a different embodiment, which is distinguished in particular by an ability to be produced at a favourable cost and/or by a simplified installation capability.

According to the invention, this problem is solved by the subjects of the independent claims. Advantageous embodiments are the subject of the dependent claims.

The invention is based on the general idea of arranging, in particular forming integrally, on the housing of a flange device a plurality of bridge sections, which in the installed state overlap the fuel distribution rail on a side facing away from the internal combustion engine. In the installed state, the fuel distribution rail is fitted onto the housing, wherein the distribution rail and the housing are separately produced components. The supporting of the bridge sections on the internal combustion engine takes place here through support sleeves, which rest on the one hand on the bridge section and on the other hand on the internal combustion engine. The housing can thereby be fastened on the one side of the fuel distribution rail directly with a flange on the internal combustion engine, whilst on the other side of the fuel distribution rail it can be fastened through the support sleeves in the region of the bridge sections on the internal combustion engine. Through the fastening of the housing on the internal combustion engine, thereby also at the same time the fuel distribution rail, which is loosely inserted, clamped or clipped into the housing, is also secured on the internal combustion engine, whereby additional fastening measures can be dispensed with. The integration of the bridge sections into the housing is particularly advantageous here. The housing, which is preferably configured as a plastic injection-moulded part, can be produced including the bridge sections with comparatively close manufacturing tolerances, whereby the fastening on the internal combustion engine is able to be realized in a simple manner. Furthermore, the handling is simplified, because the bridge sections are already correctly positioned with the arranging of the housing on the internal combustion engine. Moreover, a significant saving of weight is produced, because the bridge sections are also made from plastic and hence are comparatively light. In alternative embodiments, the bridge sections are connected detachably or non-detachably with the housing and thus form an assembly which can be used as a component constructed in one piece.

According to an advantageous embodiment, the support sleeves can be made from metal and can be inserted into the respective bridge section. Through the metallic support sleeves, particularly high tensile forces or respectively compressive forces can be supported between housing and internal combustion engine, in order to prestress the housing with sufficient force against the internal combustion engine. Through the use of the metallic support sleeves, a creeping of the plastic under tensile or respectively compressive stress is prevented.

To improve the power transmission between the bridge sections and the fuel distribution rail, the bridge sections can be formed in a contact region facing the fuel distribution rail, complementary to the fuel distribution rail, and can come to lie thereon in a laminar manner.

In accordance with a particularly advantageous embodiment, inlet pipes can be formed integrally on the housing, which are connected in a communicating manner respectively with at least one of the inlet channels. Hereby, the degree of integration of the flange device can be increased, which simplifies the handling of the flange device or respectively its installation.

In accordance with a further development, support webs can be formed integrally on the housing, which rest on the one hand on the bridge sections and on the other hand on the inlet pipes. Through these support webs, a supporting of the bridge sections on the inlet pipes therefore takes place, whereby the stability of the flange device can be increased.

According to another advantageous further development, in addition a fresh air distributor can be formed integrally on the housing, which is connected in a communicating manner with the inlet pipes on a side facing away from the inlet channels. This provision also leads to an increase in the degree of integration of the flange device, which facilitates the handling and the installation capability.

According to this further development, an intake system is formed which has all the functional units, such as e.g. flange, bridge sections, fresh air distributor, inlet pipes and inlet channels, in one component. The fuel distribution rail is clamped or clipped or loosely inserted into the intake system and is installed, together with the intake system, through this on the internal combustion engine.

According to another embodiment, the flange device, which has at least the flange, bridge sections and the inlet channels, can be embodied as a separate unit and can be joined together, in particular screwed to form a complete intake system with an intake manifold, which has at least one fresh air distributor and inlet pipes.

In an alternative embodiment, the flange device can also be connected with a different air induction unit than an intake manifold. Such air induction units can be e.g. compressors or air distributors with/without cooler.

Further important features and advantages of the invention will be apparent from the subclaims, from the drawings and from the associated figure description with the aid of the drawings.

It shall be understood that the features mentioned above and to be explained in further detail below are able to be used not only in the respectively indicated combination, but also in other combinations or in isolation, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWINGS

There are shown, respectively diagrammatically

DETAILED DESCRIPTION

Figure 1:
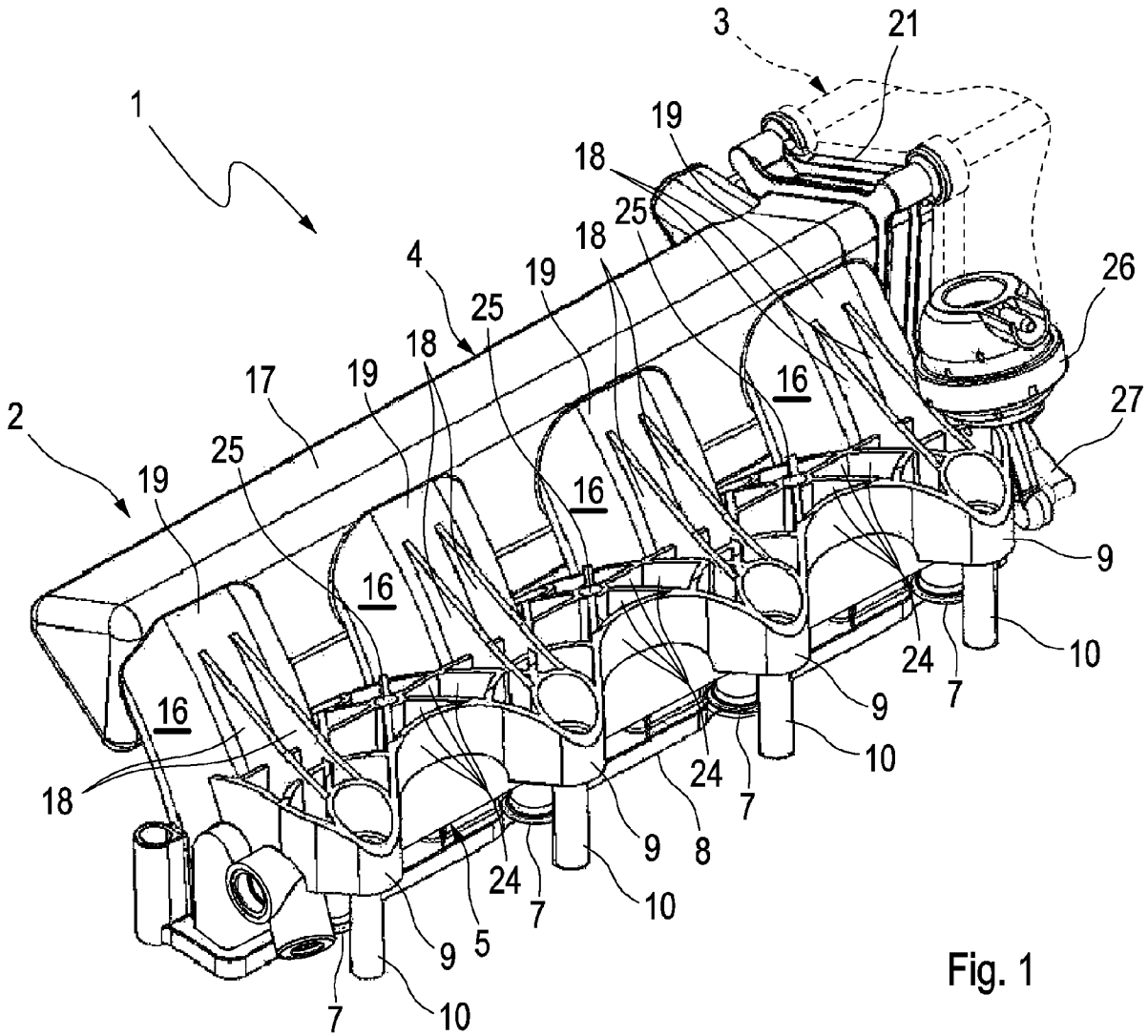
FIGS. 1 to 3 respectively a perspective view of an air induction device in the region of a flange device, in different viewing directions, FIG. 4 a top view onto the flange device, FIG. 5 a perspective sectional view of the flange device according to section lines V in FIG. 4.
Figure 2:
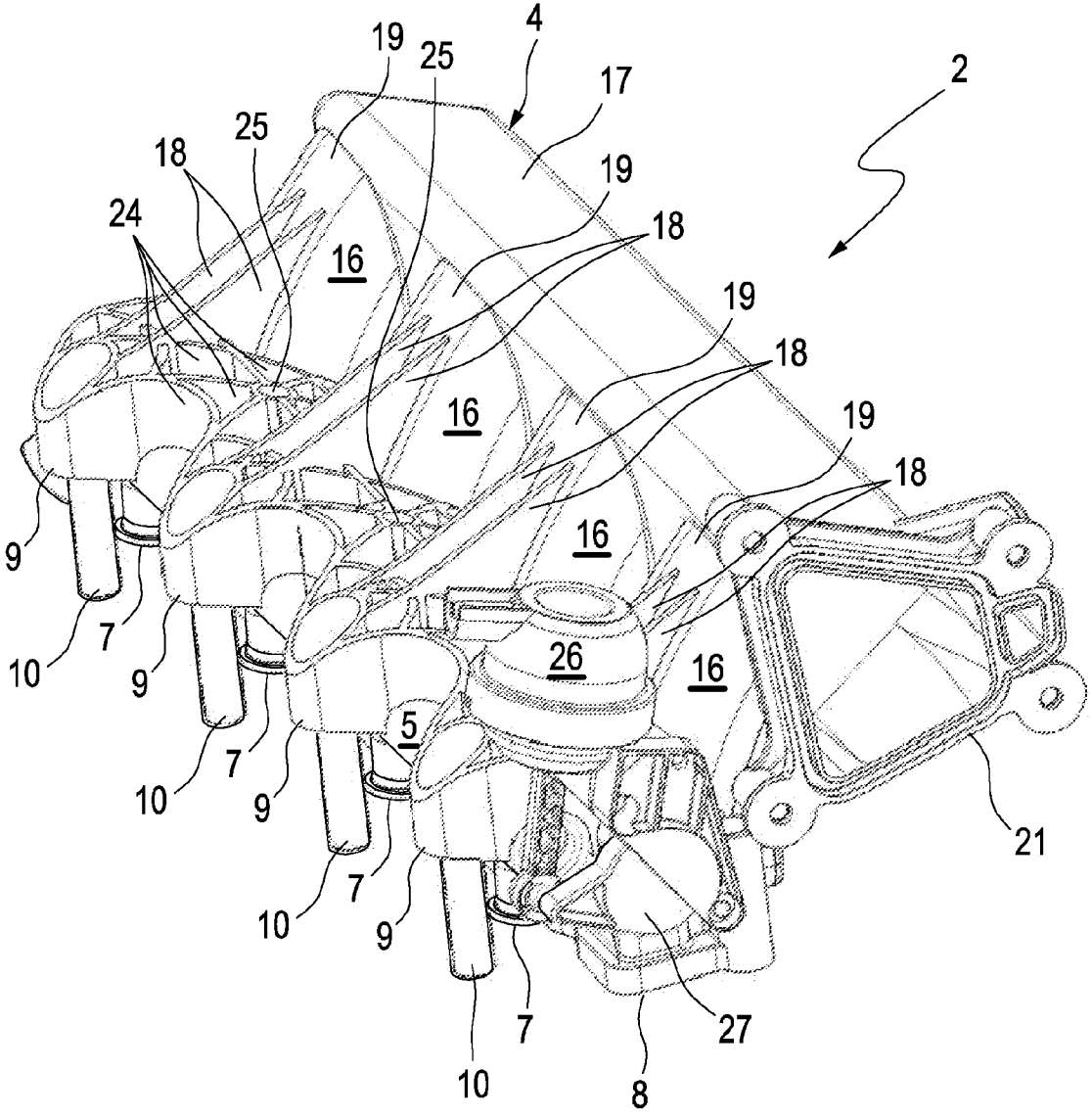
Figure 3:
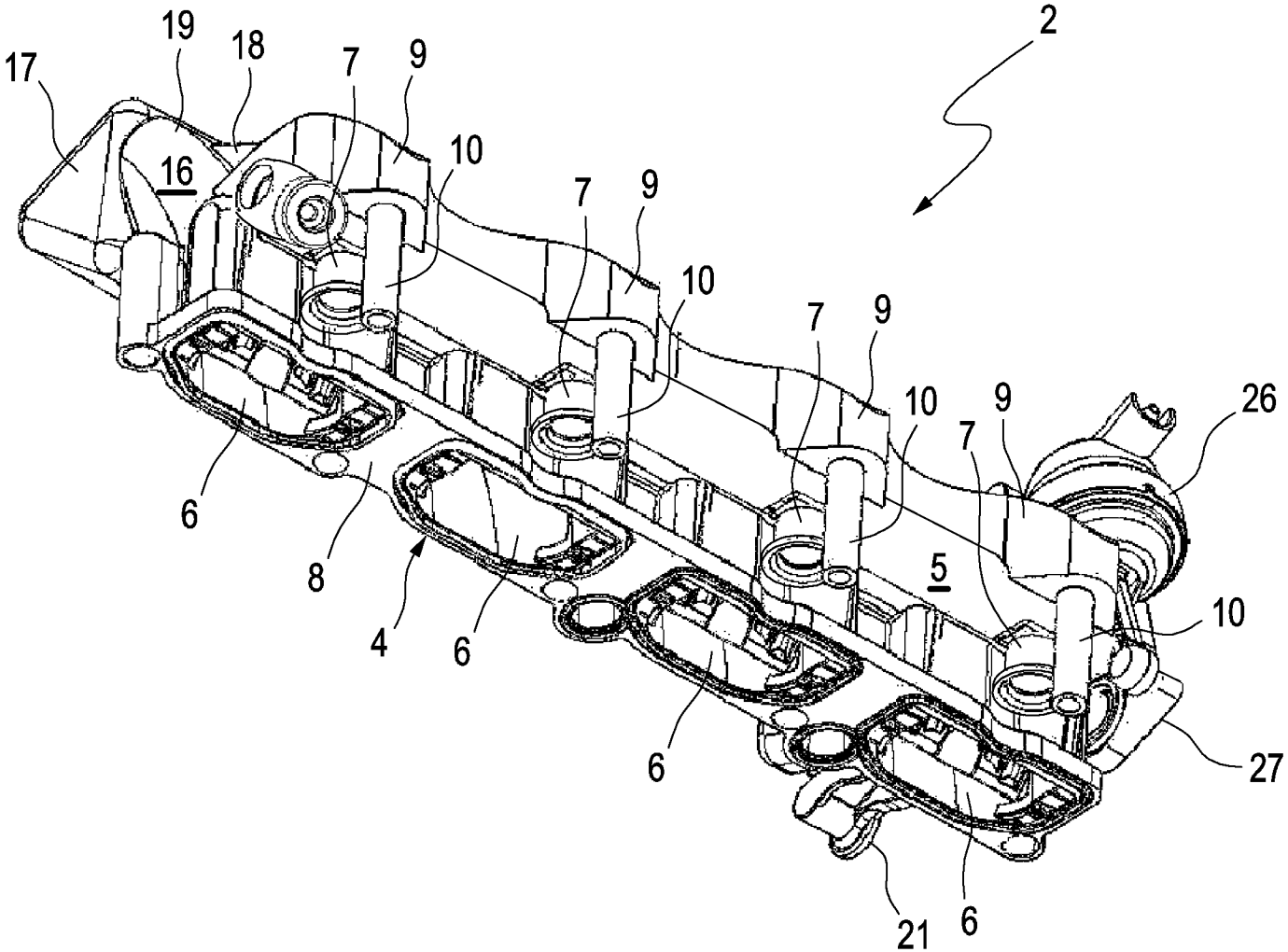

In accordance with FIG. 1, an air induction device 1, which is only partially illustrated, which can preferably be an intake system, for the fresh air supply of an internal combustion engine, which can be arranged in particular in a motor vehicle, comprises at least one flange device 2 and a fresh air line 3, which is connected to an inlet side of the flange device 2. The flange device 2 is able to be connected to the internal combustion engine, which is not illustrated. The internal combustion engine is a piston engine which has several cylinders. The flange device 2 serves for the supply of all cylinders of the internal combustion engine with fresh air, in so far as the internal combustion engine is an in-line engine. Alternatively, the flange device 2 serves for the supply of all cylinders of a cylinder bank of the internal combustion engine with fresh air, in so far as the internal combustion engine is a V-engine. The same then also applies for other engine types, such as a flat engine and a W-engine.

In accordance with FIGS. 1-5, the flange device 2 comprises a housing 4 and a fuel distribution rail 5. The housing 4 is made from plastic, in particular by injection moulding technique. The housing 4 has at least one inlet channel 6 per cylinder of the internal combustion engine. In the example—without loss of generality—precisely four inlet channels 6 are provided, which lead to four cylinders of the internal combustion engine. In this respect, the associated internal combustion engine is a four-cylinder in-line engine or a V-8 cylinder engine or abbreviated as a V8 engine.

The fuel distribution rail 5 is made from metal and has for each cylinder a connection 7 for connecting a fuel injector—not shown here. These fuel injectors serve for the injecting of fuel into the respective cylinder. They are connected jointly to the same fuel distribution rail 5 via the connections 7, so that this is a so-called common rail system. The fuel distribution rail 5 is configured here as a pipe which is distinguished by a circular cross-section. Likewise, other cross-section geometries are also conceivable for the fuel distribution rail 5, such as e.g. a rectangular cross-section.

The housing 4 has a flange 8 on one side, which in the installed state faces the internal combustion engine. This flange 8 surrounds the inlet channels 6 or respectively the outlet openings. The housing 4 can be fastened on the internal combustion engine with the flange 8. In addition, a plurality of bridge sections 9 is integrally formed on the housing 4. Expediently, such a bridge section 9 is provided per cylinder or respectively per inlet channel 6. Accordingly, the bridge sections 9 are respectively arranged at the height of one of the inlet channels 6. On a side facing away from the flange 8, the bridge sections 9 overlap the fuel distribution rail 5 which is inserted loosely or respectively clamped into the housing 4. Furthermore, the bridge sections 9 are equipped respectively with a support sleeve 10 with respect to the longitudinal direction of the housing 4. The respective support sleeve 10 is arranged here distally to the inlet channels 6 on the respective bridge section 9, such that the fuel distribution rail 5 is situated between the support sleeves 10 and the inlet channels 6. Through these support sleeves 10 the respective bridge section 9 can be fastened on the internal combustion engine.

Basically, the support sleeves 10 can be made from plastic. In this case, they can also be formed integrally on the bridge sections 9 and hence integrally on the housing 4. However, a separate production of the support sleeves 10 is preferred, whereby it is possible to produce the support sleeves 10 from metal and to mount them onto the housing 4. For this, the support sleeves 10 are inserted into the respective bridge section 9. In accordance with FIG. 5, the respective bridge section 9 for the respective support sleeve 10 can have a corresponding insertion opening 11, into which the sleeve 10 is able to be inserted. The screwing of the housing 4 with the internal combustion engine then takes place in the region of the bridge sections 9 expediently so that a screw shaft penetrates the support sleeve 10 coaxially, whilst a screw head lies, in particular via a washer, against the axial front face of the support sleeve 10 facing away from the internal combustion engine, and in so doing projects radially and thereby is also supported axially on an annular seat 12, which surrounds the insertion opening 11 on a side facing away from the internal combustion engine. In this way, the entire screwing forces are received by the support sleeve 10, so that the housing 4 is not stressed by the screwing.

The support sleeves 10 can be held here in the insertion openings 11 by a force fit or a friction fit. Likewise, it is possible to weld the support sleeves 10 into the housing 4.

Figure 4:
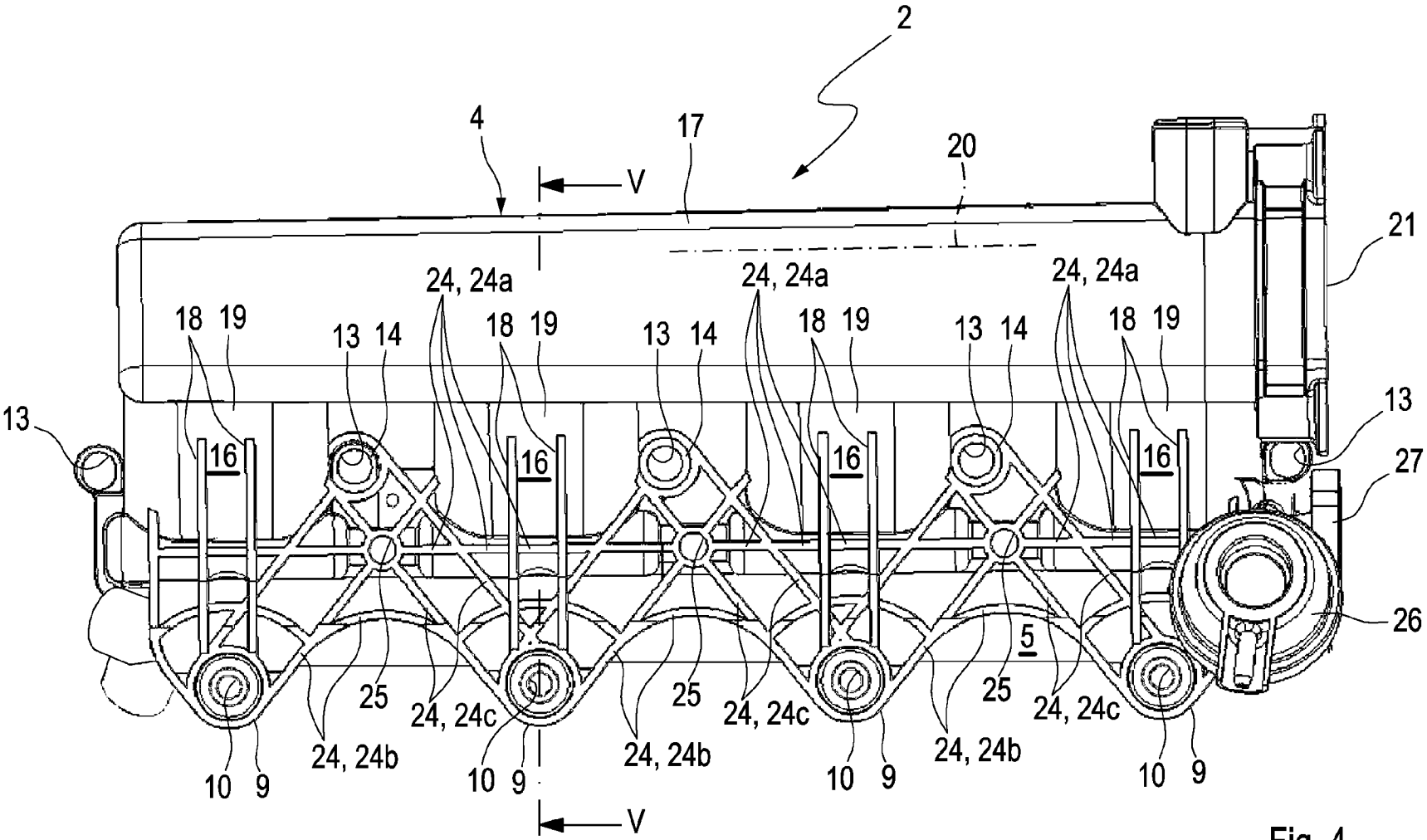

For screwing the housing 4 on the internal combustion engine on a side of the fuel distribution rail 5 facing away from the support sleeves 10, the housing 4 can have a plurality of through-openings 13 in accordance with FIG. 4, into which expediently likewise sleeves 14 can be inserted, in order to receive the screwing forces. In particular, these sleeves 14 can be welded in. Likewise, a screw head or a washer can radially overlap the axial front face of the respective sleeve 14 facing away from the internal combustion engine, in order to thus secure the housing 4 on the internal combustion engine.

Figure 5:
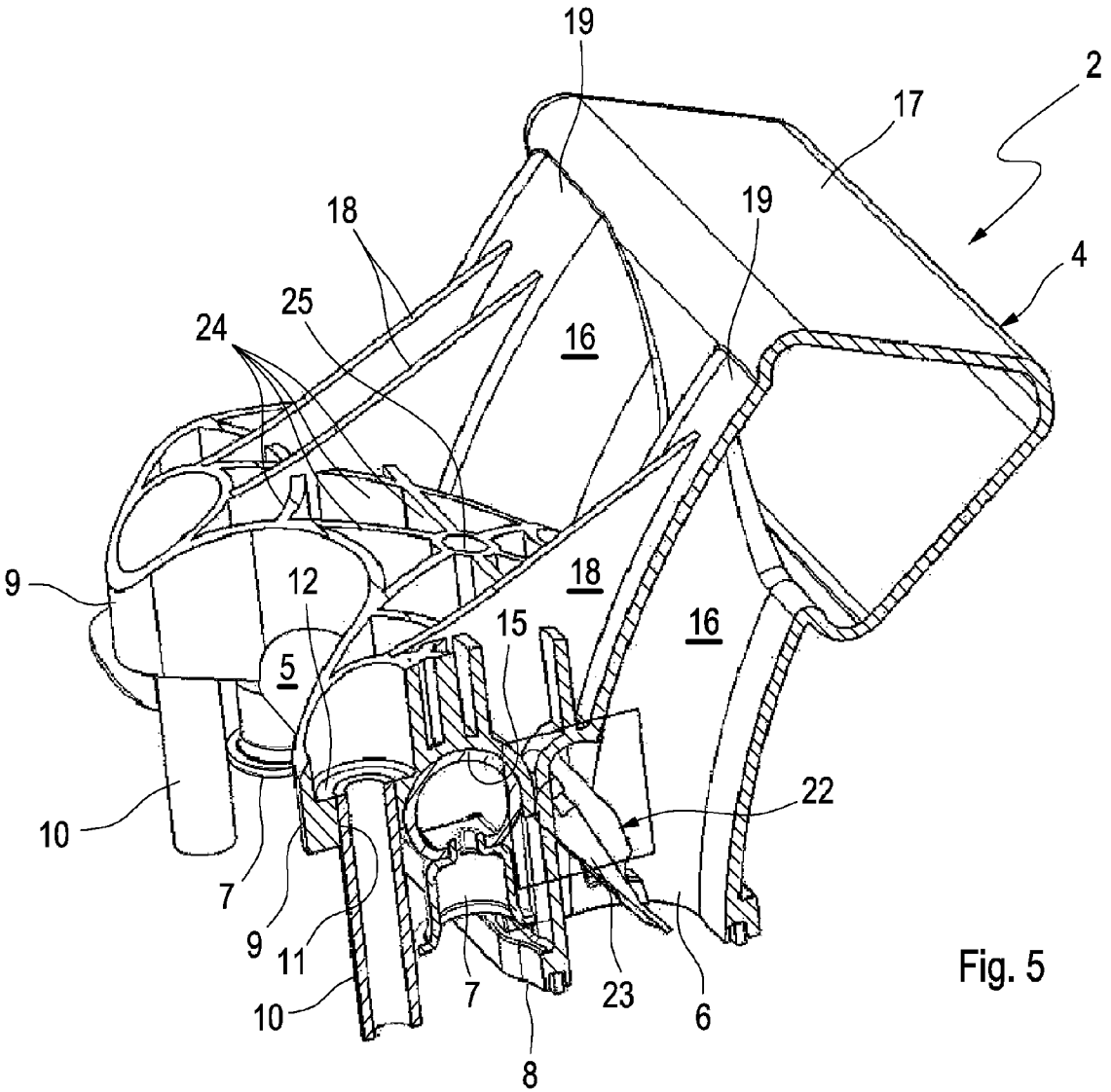

According to FIG. 5, the bridge sections 9 can be formed in a contact region 15 facing the fuel distribution rail 5 complementary to the fuel distribution rail 5, such that the fuel distribution rail 5 comes to lie in this contact region 15 in a laminar manner against the respective bridge section 9. Hereby, a particularly high power transmission can be ensured. In the example, the fuel distribution rail 5 is provided with a circular external cross-section. Matching this, the contact region 15 is configured in a semi-circular shape.

In the embodiment which is shown here, in addition a plurality of inlet pipes 16 are integrally formed on the housing 4. These inlet pipes 16 are connected in a communicating manner according to FIG. 5 respectively with at least one inlet channel 6. In the example, precisely four inlet pipes 16 are provided, which are connected in a communicating manner respectively with one of the four inlet channels 6. In an embodiment in which the housing 4 has two inlet channels per cylinder, provision may also be made to connect one inlet pipe 16 in a communicating manner with two inlet channels, which lead to the same cylinder.

In the example, in addition a fresh air distributor 17 is formed integrally on the housing 4, which distributor is connected in a communicating manner with the inlet channels 16. The fresh air distributor 17 is arranged here on the inlet pipes 16 on a side facing away from the inlet channels 6.

In the embodiment which is shown here, in addition support webs 18 are provided, which can likewise be formed integrally on the housing 4. These support webs 18 support the bridge sections 9 on the inlet pipes 16, and namely on a side facing away from the fuel distribution rail 5. For this, the support webs 18 extend on the one hand along the bridge sections 9 at least so far that they overlap the fuel distribution rail 5. On the other hand, the support webs 18 extend along the respective inlet pipe 16 up to an end region 19 of the respective inlet pipe 16, which is arranged distally to the associated inlet channel 6. In addition, the support webs 18 are configured double per bridge section 9, wherein the two support webs 18 of the respective bridge section 9 are arranged according to FIG. 4 on both sides of the respective support sleeve 10.

In the embodiment which is shown here, the fresh air distributor 17 extends parallel to a longitudinal direction 20 of the flange device 2. This longitudinal direction 20 is defined here by the direction in which the inlet channels 6 are arranged adjacent to each other. At the same time, this longitudinal direction 20 also forms the longitudinal direction of the flange 8 and of the housing 4. Therefore, in the embodiment which is shown here, the fresh air distributor 17 extends parallel to the flange 8. With regard to the longitudinal axis 20, in the embodiment which is shown here the fresh air distributor 17 can have a connection flange 21 on the front face, via which the fresh air line 3 of the intake system 1 is able to be connected to the flange device 1 or respectively to the fresh air distributor 17.

According to FIG. 5, a valve arrangement 22 can be provided in the housing 4, which has a plurality of valves 23, by means of which individual inlet channels 6 or all inlet channels 6 are able to be controlled with regard to the cross-section which is able to be flowed through. In so far as precisely one inlet channel 6 is provided per cylinder, the valve arrangement 22 can expediently have such a valve 23 per inlet channel 6. In so far as two inlet channels 6 are provided per cylinder, the valve arrangement 22 can have such a valve 32 for every other inlet channel 6.

As can be seen in particular from FIG. 4, on a side facing away from the flange 8 and facing the observer in FIG. 4, the housing 4 can have a plurality of reinforcement webs 24, which lead to an intensive reinforcement of the housing 4 in the region of the bridge sections 9. As can be seen, the reinforcement webs 24 are configured here so that respectively centrally between two bridge sections 9 a circular cylindrical node point 25 is formed, from which a plurality of reinforcement webs 24 originate in a star shape. Individual webs 24*a* extend here parallel to the longitudinal axis 20 of the housing 4 and thereby connect the individual node points 25 in a straight line with each other. Other reinforcement webs 24*b* run along the edge of the bridge sections 9 lying on the exterior. Further other reinforcement webs 24*c* connect the regions of the bridge sections 9, in which the support sleeves 10 are arranged, with the regions of the housing 4, in which the sleeves 14 are arranged.

To actuate the valve arrangement 22, an adjusting drive 26 can be provided on the front face externally on the housing 4, which drive can be configured for example as a pressure cell. The adjusting drive 26 can be drive-coupled with a lever element 27, which in turn is coupled with an actuating shaft, not shown here, such that an actuation of the adjusting drive 26 swivels the lever element 27 and thereby rotates the actuating shaft with the valves 23 arranged thereon.

The invention claimed is:

1. A flange device for an air induction device of an internal combustion engine, comprising:

a housing of plastic having at least one inlet channel for each cylinder of the internal combustion engine, a fuel distribution rail of metal having a connection for each cylinder for connecting a fuel injector, wherein the housing has a flange that surrounds outlet openings of the inlet channels configured to fasten the housing on the internal combustion engine, wherein the housing has a plurality of bridge sections that overlap the fuel distribution rail on a side facing away from the flange, wherein each bridge section has a support sleeve arranged distally to the inlet channels configured to fasten the respective bridge section on the internal combustion engine.

2. The flange device according to claim 1, wherein the support sleeves are made from metal and are inserted into the respective bridge section.

3. The flange device according to claim 2, wherein the bridge sections are formed in a contact region facing the fuel distribution rail in a laminar manner.

4. The flange device according to claim 3, further comprising inlet pipes formed integrally on the housing, the inlet pipes being respectively connected in a communicating manner with at least one of the inlet channels.

5. The flange device according to claim 2, further comprising a valve arrangement in the housing having at least one of valves of individual inlet channels and valves of all inlet channels.

6. The flange device according to claim 5, wherein on a side facing away from the flange, the housing has reinforcement webs configured to reinforce the bridge sections.

7. The flange device according to claim 6, wherein the bridge sections are at least one of mounted detachably, mounted non-detachably, and formed integrally onto the housing.

8. The flange device according to claim 7, wherein the fuel distribution rail is mounted onto the housing by being at least one of loosely inserted, clamped and clipped therein.

9. The flange device according to claim 1, wherein the bridge sections are formed in a contact region facing the fuel distribution rail in a laminar manner.

10. The flange device according to claim 9, further comprising inlet pipes formed integrally on the housing, the inlet pipes being respectively connected in a communicating manner with at least one of the inlet channels.

11. The flange device according to claim 9, further comprising a valve arrangement in the housing having at least one of valves of individual inlet channels and valves of all inlet channels.

12. The flange device according to claim 1, further comprising inlet pipes formed integrally on the housing, the inlet pipes being respectively connected in a communicating manner with at least one of the inlet channels.

13. The flange device according to claim 12, further comprising support webs formed integrally on the housing configured to support the bridge sections on the inlet pipes on a side facing away from the fuel distribution rail.

14. The flange device according to claim 12, wherein a fresh air distributor is formed integrally on the housing, the distributor being connected in a communicating manner with the inlet pipes on a side facing away from the inlet channels.

15. The flange device according to claim 14, wherein the fresh air distributor extends parallel to the flange, wherein the fresh air distributor has on its front face a connection flange configured to connect a fresh air line of an air intake system.

16. The flange device according to claim 1, further comprising a valve arrangement in the housing having at least one of valves of individual inlet channels and valves of all inlet channels.

17. The flange device according to claim 1, wherein on a side facing away from the flange, the housing has reinforcement webs configured to reinforce the bridge sections.

18. The flange device according to claim 1, wherein the bridge sections are at least one of mounted detachably, mounted non-detachably, and formed integrally onto the housing.

19. The flange device according to claim 1, wherein the fuel distribution rail is mounted onto the housing by being at least one of loosely inserted, or clamped and clipped therein.

20. An air induction device for a fresh air supply of an internal combustion engine, comprising:

a housing of plastic having at least one inlet channel for each cylinder of the internal combustion engine, a fuel distribution rail of metal having a connection for each cylinder for connecting a fuel injector, wherein the housing has a flange that surrounds outlet openings of the inlet channels configured to fasten the housing on the internal combustion engine, wherein the housing has a plurality of bridge sections that overlap the fuel distribution rail on a side facing away from the flange, wherein each bridge section has a support sleeve arranged distally to the inlet channels configured to fasten the respective bridge section on the internal combustion engine.

* * * * *